US005223370A

United States Patent [19]

Sacripante et al.

[11] Patent Number: 5,223,370

[45] Date of Patent: Jun. 29, 1993

[54] LOW GLOSS TONER COMPOSITIONS AND PROCESSES THEREOF

[75] Inventors: Guerino G. Sacripante; Raj D. Patel, both of Oakville; Grazyna Kmiecik-Lawrynowicz; Hock S. Tan, both of Burlington; Walter Mychajlowskij, Georgetown, all of Canada

[73] Assignee: Xerox Corporation, Stamford, Conn.

[21] Appl. No.: 802,976

[22] Filed: Dec. 6, 1991

[51] Int. Cl.[5] ..... G03G 9/093

[52] U.S. Cl. ..... 430/138; 430/99

[58] Field of Search ..... 130/106.6, 107, 138, 130/99

[56] References Cited

U.S. PATENT DOCUMENTS

| | | | |
|---|---|---|---|
| 3,016,308 | 1/1962 | Macaulay | 117/36.7 |
| 3,405,070 | 10/1968 | Reyes | 252/316 |
| 4,524,199 | 6/1985 | Lok et al. | 527/313 |
| 4,565,764 | 1/1986 | Nakahara et al. | 430/111 |
| 4,576,890 | 5/1986 | Hosoi | 430/137 |
| 4,626,489 | 12/1986 | Hyosu | 430/137 |
| 4,652,508 | 3/1987 | Ober et al. | 430/109 |
| 4,727,011 | 2/1988 | Mahabadi et al. | 430/138 |
| 4,797,339 | 1/1989 | Maruyama et al. | 430/109 |
| 4,851,318 | 7/1989 | Hsieh et al. | 430/137 |
| 4,996,127 | 2/1991 | Hasegawa et al. | 430/109 |
| 5,045,422 | 9/1991 | Kmiecik-Lawrynowicz et al. | 430/138 |

*Primary Examiner*—John Goodrow
*Attorney, Agent, or Firm*—E. O. Palazzo

[57] ABSTRACT

An encapsulated toner composition and process thereof, which toner is comprised of a core comprised of a polymer resin or resins, color pigment, dye, or mixtures thereof, and thereover an inner shell resin comprised, for example, of a polyurea, and thereover an outer shell coating comprised of an alkyl cellulose. The colored encapsulated toners are useful in reprographic processes wherein, for example, low gloss is desired.

44 Claims, No Drawings

LOW GLOSS TONER COMPOSITIONS AND PROCESSES THEREOF

BACKGROUND OF THE INVENTION

The present invention is generally directed to toner compositions and processes thereof, and more specifically, to colored encapsulated toner compositions and processes thereof, and wherein toners can be directly generated without resorting to the conventional pulverization and classification methods. In one embodiment, the present invention relates to colored encapsulated toner compositions which display low gloss levels of, for example, from about 1 gloss unit to about 15 gloss units, and more preferably from about 3 gloss units to about 14 gloss units, as measured by the Gardner TM gloss unit apparatus. In another embodiment, the present invention relates to a process of preparing colored encapsulated toner of fine particle size of from about 0.5 micron to about 15 microns in diameter, and more preferably from about 2 microns to about 7 microns diameter, as measured by a Counter Counter. In another embodiment, the present invention relates to colored encapsulated toner compositions which display low fixing temperatures of from about 110° C. to about 150° C., thereby reducing the energy consumption of an electrostatographic imaging or printing apparatus and prolonging the lifetime of the fuser contained therein. Furthermore, in another embodiment, the present invention relates to a colored encapsulated toner composition and process of generating an inner shell material surrounding a core material and wherein the resulting composite is surrounded by an outer shell or coating material. The colored encapsulated toners of this invention in embodiments are comprised of a core comprised of a polymer resin and colorants, including color pigments, dyes, or mixtures thereof, an inner shell material comprised of, for example, a polyurea, a polyurethane or a polyester and the like, and an outer coating layer comprised of a cellulose component, such as methyl cellulose, hydroxypropyl cellulose, hydroxyethylmethyl cellulose, and the like. The processes of the present invention in embodiments thereof are comprised of an initial dispersion step for forming a stabilized organic microdroplet suspension comprised of pigment, dyes or colorant, free-radical monomers, and an inner shell forming monomer such as a diisocyanate suspended in an aqueous medium containing an outer coating material, such as hydroxyethylmethyl cellulose; followed by addition of the second monomer forming the inner shell material by interfacial polymerization step, such as a diamine; and a final core resin formation step by free radical polymerization. The precipitation of the outer coating cellulose molecules is believed to begin at the initial dispersion-stabilization stage, and continues during the inner shell formation and core resin forming free radical polymerization step. In embodiments, the processes of the present invention can also utilize a mixture of cellulose polymers of from about 0.1 percent to about 5 percent by weight of the toner, and ionic or inorganic surfactants of from about 0.01 percent to about 0.5 percent by weight of toner, such as potassium oleate, sodium dodecyl sulfate, and the like during the dispersion step. The cellulose-ionic or inorganic surfactant system facilitates efficient generation of very small sized microdroplets, particularly those with an average particle diameter of from about 0.5 micron to about 7 microns, together with a narrow particle size distribution of less than 1.35, as measured by the Counter Counter.

The primary function of the inner shell of the colored encapsulated toner of the present invention is to provide for the mechanical integrity of the toner, minimizing or eliminating the seepage of the inner core material, hence preventing toner aggregation or coalescing, as well as providing the low gloss properties to the toner image, highly desired in black and highlight reprographic technologies utilizing a VITON ® roll fuser. The primary function of the outer cellulose shell for the colored encapsulated toner compositions prepared by the processes of the present invention is to provide additional low gloss or preferably a matte finish. In addition, this outer coating shell is selected to provide additional mechanical integrity to the toner compositions, and ensure effective protection with the inner shell material for the containment of the core components. In addition, the coatings also inhibit toner particles from coalescing and prevent, or minimize toner agglomeration during the dispersion step and interfacial polymerization step for generating the inner shell. The primary function of the outer shell coatings relates to the nullification, or passivation of the triboelectric charging effects of colorants present in the toner compositions, such that the triboelectric charging characteristics of the toner compositions are primarily controlled or dominated by the charging effects of the cellulose layer, and surface additives. Accordingly, the processes of the present invention are useful for the preparation of a wide variety of colored toners possessing similar or substantially similar triboelectric charging characteristics with a selected carrier, irrespective of the nature of the colorants present in the toners. For single component development where triboelectric charging is generally accomplished by a frictional charging blade, similar equilibrium triboelectric charge levels can also be obtained under substantially identical conditions with different colored toners of the present invention. The cellulose coating for the toner compositions obtained by the processes of the present invention are in general relatively thin in nature, its presence therefore does not substantially affect the toner's fusing characteristics.

In color reprography, such as in full color or highlight color applications, colored toners with a wide variety of colors including black are usually employed. In color reprography, a heat-assisted transfix step or heat-roll fusing is applied to the toner image on paper. It is highly desirable to use VITON ® fuser rollers rather than the conventional silicone roll fusers due to the drastically prolonged lifetime attained by a fuser roll containing VITON ® surfaces. During the fixing step employing heated VITON ® roll fusers, the toner is fixed on paper and the energy necessary to achieve this is related to the temperature applied by the rolls. Accordingly, toners which fix on paper with minimum amount of heat are highly desirable. The temperature necessary to properly fix a particular toner onto paper is known as the minimum fixing temperature (MFT). It is known that encapsulated toner compositions are highly desirable for low minimum fixing applications, such as from about 110° C. to about 150° C., and preferably from about 110° C. to about 130° C. The aforementioned encapsulated colored toners are comprised of an inner core with low glass transition temperature resin for fixing the toner onto paper at the low aforementioned minimum fixing temperatures, in that the core of the encapsulated toner is surrounded by a shell material thereby avoiding agglomeration of the core materials during, for example, storage or until its use in the final fixing step. Toner fusing onto paper is accomplished by the melting of the toner and its penetration into the paper fiber, and sticking or adherence of the resin onto the paper with colorants, dyes and additives. After this fixing step, the surface of the toner image on paper is usually smooth, and in addition, paper calendering results especially when excessive pressure is applied by the fuser, such that the toner image surface and paper is very smooth. This aforementioned fixing mechanism is responsible for high gloss properties to the toner image, such as from about 40 gloss units to about 80 gloss units, as measured by the GARDNER TM gloss unit. The gloss level is proportional to the smoothness of the toner image after fixing, and can easily be measured using a known GARDNER TM gloss unit. In color reprography, such as full or pictorial color applications, high gloss is highly desirable such as from about 40 gloss units to about 80 gloss units and more preferably from about 45 to about 60 gloss units, as measured by the GARDNER TM gloss unit on toner image after fixing. When using colored conventional toners for full or pictorial colored applications, high gloss is easily achieved, and the use of colored encapsulated toners comprised of a core containing resin, pigment, dyes or colorant and optionally surrounded by a shell for full color or pictorial applications, high gloss can be achieved. For color reprography, wherein black or highlight color application is desired, low gloss is desired, and preferably low gloss of less than 14 gloss units and more preferably less than 11 gloss units as measured by the GARDNER TM gloss unit. Gloss values of from about 14 gloss units and below are usually known to those in the art as "matte finish". However, both the aforementioned conventional and prior art encapsulated colored toners do not exhibit low gloss values, and are inferior to black and highlight color reprographic technologies which utilizes VITON ® roll fusers. The colored encapsulated toner compositions of this invention alleviate the problem of high gloss and provide low gloss black and highlight colored images, and more preferably of a matte finish when transfixed using VITON ® fuser rolls. Furthermore, the colored encapsulated toners of this invention can be of a fine average particle size of from about 0.5 micron to about 9 microns and more preferably from about 2 microns to about 7 microns in diameter, unattainable economically by conventional pulverization process. Additionally, the encapsulated toner compositions of this invention display low minimum fixing characteristics with excellent tribo characteristics such that the triboelectric properties of different colored toners be desirably controlled so that they all attain similar equilibrium triboelectric charging levels when utilized with a selected carrier. This is especially useful for custom colored toner packages since colored toners with a wide variety of custom colors can be obtained by simple blending of the primary colored toners. Another important aspect for two component development is the rate of charging of new toner to equilibrium charge levels when they are added to the toner depleted development housing. A fast rate of charging of fresh toner can be important in ensuring proper image development, particularly for high speed, greater than 70 copies per minute for example, reprographic systems.

It is known that color pigments or dyes present in the toner have a dominant effect on the toner's triboelectric charging behavior, arising primarily because these colorants are often also present at or close to the surface of the toner, and are, therefore, exposed to their environments. As a consequence, when the toner particles are admixed with carriers, the interactions of the exposed pigments of the toners with the carrier particles drastically affect the charging behavior of the toner. Similar effects are obtained for a number of prior art encapsulated toners where the color pigment particles are not completely encapsulated within the toner shell. Thus, it is often observed that toners with identical components, except colorants, exhibit different charging behavior, even to the extent of having triboelectric charges of opposite polarity. To overcome this difficulty, it is usually necessary to utilize different charge control additives for different colorants, or to use high levels of charge control additives so as to nullify or overcome the different charging effects of different colorants, and exert a dominating influence on the charging characteristics of the toners. The toners and processes of the present invention eliminate or overcome this difficulty through complete or substantially complete encapsulation of core components with an inner shell, and in addition, by the precipitation of an outer coating on the inner shell. As a consequence, the need to rely on only one shell material is avoided by the use of an additional outer layer precipitated coating of this invention. It is believed that the inner shell and outer shell precipitated coating, especially when TYLOSE ® is employed, avoids toner smoothness after the fixing step, and alleviates unwanted gloss properties for black and highlight color reprographic technologies employing VITON ® roll fusers. Other advantages associated with the toner compositions obtained by the processes of the present invention include, for example, rapid triboelectric charging rates, small toner size and narrow size distribution for high resolution images, excellent color mixing properties and image color fidelity, low minimum fusing temperatures, acceptable powder flow, and nonblocking and nonagglomerating characteristics. The toner compositions of the present invention can be selected for a variety of known imaging processes including electrophotographic and ionographic processes. It is also known that colored, including black single component magnetic toners, as well as encapsulated single component magnetic toners for ionographic applications, exhibit undesired high gloss properties, such as from about 40 gloss unit to about 80 gloss. This is primarily due to the high pressures exerted by the dielectric receivers on the toner image. The colored, including black, toners of this invention contain an additional outer coating not present in prior art toners, enabling the toner images with low gloss and preferably matte in finish.

Encapsulated toners and processes containing two shells are known. For example, U.S. Pat. No. 4,565,764 discloses a colored microcapsule toner composition and process thereof comprised of a core comprised of a wax and colorant, a first shell resin wall having an affinity for both the core and a second shell wall; and note column 3, line 13, wherein the first wall is chemically bonded to at least the second wall and core material, and note column 7, line 65, to column 8, line 5, wherein the first resin wall is oppositely charged to those of the core material and second resin wall. Furthermore, the microcapsules are prepared by a coacervation or phase separation process. U.S. Pat. No. 4,797,339 discloses a toner comprising an inner layer comprising a resin ion complex having a colorant and ionically crosslinked with a resin of opposite charge, and containing an outer layer comprised of flowability imparting agent. Similarly, U.S. Pat. No. 4,996,127 teaches a process of producing microcapsule toner composed of associated particles of secondary particles comprising primary particles of a polymer having an acidic or basic polar group, coloring agent and charge controlling agent. With the present invention in embodiments, the inner shell and outer shell are not chemically or ionically bound, and contain an interfacial polymer resin, such as a polyurea, for low gloss attributes, and also the outer coating material, such as TYLOSE ®, is not believed to be disclosed in '497, '764 or '127, which TYLOSE ® is selected for low gloss and triboelectricity control. Additionally, the microcapsule of this invention is prepared by a suspension free-radical process, followed by interfacial polymerization, and coating thereof. Encapsulated toners and processes containing one shell are also known, for example, both U.S. Pat. No. 4,626,489 and British Patent 1,538,787, as well as U.S. Pat. No. 4,766,051 disclose similar processes for colored encapsulated toners wherein both the core resin and shell material are prepared by suspension polymerization techniques. However, only one shell material is present in the toner compositions of the aforementioned prior art. Similarly, other prior art, such as U.S. Pat. No. 4,727,011, discloses a process for preparing encapsulated toners which involves a shell forming interfacial polycondensation and a core binder forming free radical polymerization; and U.S. Pat. No. 4,708,924 discloses the use of a mixture of two polymers, one having a glass transition temperature in the range of −90° C. to 5° C., and the other having a softening temperature in the range of 25° C. to 180° C., as the core binders for a pressure fixable encapsulated toner. Other representative U.S. Pat. Nos. are: 4,339,518, which relates to a process of electrostatic printing with fluorinated polymer toner additives where suitable materials for the dielectric toner are thermoplastic silicone resins and fluorine containing resins having low surface energy; U.S. Pat. No. 4,016,099, which discloses methods of forming encapsulated toner particles and wherein there are selected organic polymers including homopolymers and copolymers, such as vinylidene fluoride, tetrafluoroethylene, chlorotrifluoroethylene, and the like; U.S. Pat. No. 4,497,885, which discloses a pressure fixable microcapsule toner comprising a pressure fixable component, a magnetic material, and other optional components, and wherein the core material can contain a soft material, typical examples of which include polyvinylidene fluoride, polybutadiene, and the like; U.S. Pat. No. 4,520,091, which discloses an encapsulated toner with a core which comprises a colorant, a dissolving solvent, a nondissolving liquid and a polymer, and may include additives such as a fluorine containing resin; and U.S. Pat. No. 4,590,142 relating to capsule toners wherein additives such as polytetrafluoroethylenes are selected as lubricating components. Furthermore, there are disclosed in the prior art encapsulated toner compositions containing costly pigments and dyes, reference for example the color photocapsule toners of U.S. Pat. Nos. 4,399,209; 4,482,624; 4,483,912 and 4,397,483.

In a U.S. Pat. No. 5,175,071 (D/90516), the disclosure of which is totally incorporated herein by reference, a colored encapsulated toner comprised of a core resin and colorant, coated with a cellulose shell material is disclosed, and wherein no inner shell material is present and low gloss properties are not disclosed. Furthermore, the gloss properties with the colored encapsulated toner compositions of this patent, containing only one shell are not attained generally as illustrated herein.

The following U.S. patents located in a patentability search report for encapsulated toners are mentioned: U.S. Pat. No. 4,967,962, which discloses a toner composition comprising a finely divided mixture comprising a colorant and a polymeric material which is a block or graft copolymer, including apparently copolymers of polyurethane and a polyether (column 6), reference for example the Abstract of the Disclosure, and also note the disclosure in columns 2, 3, 6 and 7, particularly lines 13 and 35; however, it does not appear that encapsulated toners are disclosed in this patent; 4,626,490 contains a similar teaching as the '764 patent, and more specifically, discloses an encapsulated toner comprising a binder of a mixture of a long chain organic compound and an ester of a higher alcohol and a higher carboxylic acid encapsulated within a thin shell, reference the Abstract of the Disclosure, for example, and note specifically examples of shell materials in column 8, beginning at line 64, and continuing on to column 9, line 17, which shells can be comprised, for example, of polyurethanes, polyurea, epoxy resin, polyether resins such as polyphenylene oxide or thioether resin, or mixtures thereof; U.S. Pat. Nos. 4,442,194 and 4,465,755, mentioned herein; and U.S. Pat. Nos. of background interest including 4,520,091; 4,590,142; 4,610,945; 4,642,281; 4,740,443 and 4,803,144.

Furthermore, other prior art, primarily of background interest, includes U.S. Pat. Nos. 4,254,201; 4,465,755 and Japanese Patent Publication 58-100857. The Japanese publication discloses a capsule toner with high mechanical strength, which is comprised of a core material including a display recording material, a binder, and a shell, which shell is preferably comprised of a polyurea resin. In the U.S. Pat. No. '201 there are disclosed encapsulated electrostatographic toners wherein the shell material comprises at least one resin selected from polyurethane resins, a polyurea resin, or a polyamide resin. In addition, the U.S. Pat. No. '755 discloses a pressure fixable toner comprising encapsulated particles containing a curing agent, and wherein the shell is comprised of a polyurethane, a polyurea, or a polythiourethane. Moreover, in the U.S. Pat. No. '201 there are illustrated pressure sensitive adhesive toners comprised of clustered encapsulated porous particles, which toners are prepared by spray drying an aqueous dispersion of the granules containing an encapsulated material.

Also, in U.S. Pat. No. 4,599,271, the disclosure of which is totally incorporated herein by reference, there are illustrated microcapsules obtained by mixing organic materials in water emulsions at reaction parameters that permit the emulsified organic droplets of each emulsion to collide with one another, reference the disclosure in column 4, lines 5 to 35. Examples of polymeric shells are illustrated, for example, in column 5, beginning at line 40, and include isocyanate compounds such as toluene diisocyanate, and polymethylene polyphenyl isocyanates. Further, in column 6, at line 54, it is indicated that the microcapsules disclosed are not limited to use on carbonless copying systems; rather, the film material could comprise other components including xerographic toners, see column 6, line 54.

Illustrated in U.S. Pat. No. 4,758,506, the disclosure of which is totally incorporated herein by reference, are single component cold pressure fixable toner compositions, wherein the shell selected can be prepared by an interfacial polymerization process. In U.S. Pat. No. 5,043,240, the disclosure of which is totally incorporated herein by reference, there are illustrated encapsulated toners with a core comprised of a polymer binder, pigment or dye, and thereover a polymeric shell, which contains a soft and flexible component, permitting, for example, proper packing of shell materials resulting in the formation of a high density shell structure, which can effectively contain the core binder and prevent its loss through diffusion and leaching process. The soft and flexible component in one embodiment is comprised of a polyether function. Specifically, in one embodiment there are disclosed in the aforementioned patent encapsulated toners comprised of a core containing a polymer binder, pigment or dye particles, and thereover a shell preferably obtained by interfacial polymerization, which shell has incorporated therein a polyether structural moiety. Another specific embodiment of the patent is directed to encapsulated toners comprised of a core of polymer binder, pigment, dye or mixtures thereof, and a polymeric shell of a polyether-incorporated polymer, such as a poly(ether urea), a poly(ether amide), a poly(ether ester), a poly(ether urethane), mixtures thereof, and the like.

Many of the prior art encapsulated toner compositions, in particular colored toner compositions, suffer from a number of deficiencies as indicated herein. For example, these toners do not possess, it is believed, desirable low gloss of from about 14 gloss units and below and more preferably less than 11 gloss units or a matte finish in color reprography utilizing VITON® fusers. The prior art encapsulated toner compositions contain only one shell material, or do not contain an inner shell material and outer shell material to enable low gloss applications, such as from about 1 gloss unit to about 14 gloss units. The gloss property of some of the prior art colored encapsulated toner compositions containing only one shell are reported in the Comparative Examples, and wherein the desired low gloss properties of from about 1 gloss unit to about 14 gloss units are not attained. Also, many of the prior art encapsulated toners do not display fusing properties such as being able to be fused at a reasonably low temperature of, for example, less than 160° C.; they usually require different or excessive amounts of charge control agents for different colored toners; and their rates of triboelectric charging are poor. In addition, some prior art colored encapsulated toners cannot be obtained in smaller toner size of, for example, less than 7 or 8 microns in diameter with a narrow size distribution of less than about 1.35, and more preferably of from about 2 to about 7 microns with a narrow size distribution of less than about 1.35 in a cost effective manner. Also, toner blocking or agglomeration may be a problem with several of the prior art encapsulated toners because of the porosity of the shell structure, especially when they are exposed to conditions of elevated temperatures. Further, some of the prior art colored encapsulated toners are comprised of colored pigment particles that may not completely be encapsulated by the shell, and the triboelectric charging effects of such pigments are, therefore, not fully passivated, and this would adversely affect and degrade the toner triboelectric characteristics, thereby causing image quality to deteriorate. In addition, many of the prior art toner compositions do not possess the necessary long-term physical and environmental stability. These and other disadvantages are eliminated or substantially eliminated with the process and toner compositions of the present invention.

There is a need for colored toners which display low gloss values and are preferably matte finish, especially with color reprographic systems employing VITON® fuser rolls. Additionally, there is a need for color toners with low minimum fusing temperatures, wide fusing latitude, of fine particle size, of nonblocking tendencies, and of stable triboelectricity properties including complete passivation. These and other needs are accomplished with the colored encapsulated toners and process thereof of the present invention. More specifically, thus with the toners of the present invention, the toner properties can in many instances be tailored to certain specifications. Specifically, with the toners of the present invention in embodiments, low gloss images of matte finish are attainable with reprographic technologies employing VITON® fuser rolls. Additionally, complete or substantial passivation of the triboelectric charging effects of the colorants is accomplished, and smaller toner particle size with narrow size distribution can be achieved without conventional classification techniques. Also, the toners of the present invention do not block or agglomerate over an extended period of time, for example up to six months, in embodiments.

SUMMARY OF THE INVENTION

It is a feature of the present invention to provide toner compositions with many of the advantages illustrated herein.

It is also a feature of the present invention to provide colored encapsulated toner compositions, including black, with desirable low gloss and matte finish prints.

Additionally, it is a feature of the present invention to provide desirable properties as excellent toner powder flow, and nonblocking characteristics, excellent color fidelity, resistance to vinyl offset, and excellent image permanence characteristics.

In another feature of the present invention, there are provided toner compositions comprised of a core of polymer resin, colorants such as pigments, dyes, or mixtures thereof, and thereover an inner shell comprised of polyurea, polyurethane, polyesters and the like, and thereover an outer shell coating comprised of TYLOSE®, a hydroxyethylmethyl cellulose, a methyl cellulose, or the derivatives thereof.

An additional feature of the present invention is the provision of toner compositions whose low gloss properties are predominantly controlled by the inner shell and outer cellulose layer.

Another feature of the present invention is the provision of toner compositions whose triboelectric properties are predominantly controlled by the outer cellulose layer, and the optionally added surface additives.

Further, in another feature of the present invention, there are provided color toners which exhibit similar equilibrium triboelectric properties against a selected carrier irrespective of the colorants present.

A related feature of the present invention is the provision of colored toner compositions whose triboelectric charging polarity can be desirably controlled or adjusted.

A still further related feature of the present invention is to provide colored toners which possess rapid rates of triboelectric charging when admixed with carrier particles.

Moreover, another feature of the present invention is the provision of colored toners exhibiting low temperature fusing properties.

A further feature of the present invention is to provide a simple process for the generation of small sized black and colored toners with narrow size distribution without the need to resort to conventional pulverization and classification techniques.

In a further feature of the present invention, there are provided preparative processes for directly generating toner compositions comprised of a polymer resin or resins and colorants, encapsulated by an inner shell condensation resin and an outer overcoated layer of a cellulose polymer, and wherein the gloss level of the toner image after fixing is of matte finish.

Another related feature of the present invention is the provision of a simple chemical preparation process for toner compositions wherein no toxic reagents are utilized.

These and other features of the present invention can be accomplished by the provision of toners, and more specifically, toners with an inner shell and certain coating thereover. In one embodiment of the present invention, there are provided toners with a core comprised of a polymer resin, colorants, such as pigment or dye, and thereover an inner shell comprised of a polyurea, a polyurethane, a polyether, a polyamide, or a polyester, and thereover an outer shell coating comprised of a cellulose polymer, such as methyl cellulose, a mixture of methyl cellulose and methyl ethylcellulose, available as TYLOSE ® from Fluka Biochemica Company, and the like. The aforementioned inner and outer shells are believed to yield low gloss or matte finish prints of from about one gloss unit to about 14 gloss units, especially when reprographic technologies employing VITON ® fusers are utilized. The aforementioned outer coatings can also passivate or nullify the triboelectric charging effects of the colorants present in the toner compositions, thereby providing for the achievement of similar triboelectric properties for different colored toners. Specifically, in one embodiment there are provided in accordance with the present invention toners whose gloss level and triboelectric charging properties are primarily controlled by the inner and outer coating, and the added surface additives. The toner compositions of the present invention in embodiments are comprised of a core containing a polymer resin, color pigment particles or dye components, and thereover an inner shell comprised of condensation polymer, such as a polyurea, with effective thickness of, for example, from between about 0.1 to 2 microns as measured by Tunnelling Electron Microscopy (TEM), and thereover an outer shell coating comprised of cellulose polymer, such as hydroxyethylmethyl cellulose, with an effective thickness of, for example, from between about 0.0001 to about 0.5 micron as measured by TEM. Another specific embodiment of the present invention is directed to color toners whose outer cellulose coatings have been removed or substantially removed or chemically modified so as to provide other specific properties.

The toner compositions of the present invention can be prepared by a simple one-pot process involving formation of stabilized particle suspension, followed by an interfacial inner shell polymerization, and by a core resin forming free radical polymerization within the particles. The outer shell coating is believed to be initially formed during the stabilized particle suspension, and continues to be formed by precipitation during the inner shell and core free-radical steps. The process is comprised of, for example, (1) thoroughly mixing or blending a mixture of core resin monomers, optional preformed core resins, free radical initiators, colorants, and an inner shell forming monomer such as a diisocyante (DESMODUR W TM); (2) dispersing the aforementioned well blended mixture by high shear blending to form stabilized microdroplets of specific droplet size and size distribution in an aqueous medium containing a suitable outer shell coating cellulose polymer, such as TYLOSE ®, and an optional ionic or inorganic surfactant, such as sodium dodecyl sulfate, to control the desired particle size, and wherein the volume average microdroplet diameter can be desirably adjusted to be from about 2 microns to about 15 microns with the volume average droplet size dispersity being less than 1.35; (3) adding the second inner shell monomer such as a diamine (DYTEK A TM) which diffuse through the outer coating and condenses with the diamine inner shell forming monomer via an interfacial polymerization mechanism resulting in a polyurea inner shell material; (4) effecting the free radical polymerization to form the core resin by heating; and (5) processing the resulting particles by washing, drying and treating with known surface additives. The formation of stabilized particle suspension is generally conducted at ambient, about 25° C. in embodiments, temperature, while the free radical polymerization can be accomplished at a temperature of from about 35° C. to about 120° C., and preferably from about 45° C. to about 90° C., for a period of time of from about 1 to about 24 hours depending primarily on the monomers and free radical initiators used. The core resin obtained via free radical polymerization, together with the optional preformed polymer resin, comprises from about 60 to about 95 percent, and preferably of from about 75 to about 95 percent by weight of toner, the colorant comprises from about 1 to about 15 percent by weight of the toner, the inner shell material comprises from about 5 to about 30 percent by weight and more preferably from about 10 to about 20 percent by weight, the outer shell cellulose coating comprises from about 0.001 to about 5 percent by weight of the toner, while the surface additives like flow aids, surface release agents, and charge control chemicals can comprise from about 0.1 to about 5 percent of toner in embodiments thereof.

The volume average particle size of the colored encapsulated toners of this invention in embodiments can be controlled by appropriately adjusting the concentration of the outer coating material and ionic or inorganic surfactant. For example, in an embodiment, the colored encapsulated toner process of this invention can be controlled such that the volume average toner particle size is 7 microns in diameter by adjusting the outer coating cellulose material, such as TYLOSE ®, of from about 0.75 to about 1 percent by weight of water, and utilizing an ionic surfactant such as sodium dodecylsulfate of from about 0 to about 0.005 percent by weight of water. In another embodiment, the volume average particle size of the colored encapsulated toner can be controlled to about 5 microns in diameter by adjusting the outer coating cellulose material, such as TYLOSE ®, of from about 0.75 to about 1 percent by weight of water, and the ionic surfactant, such as sodium dodecyl sulfate, of from about 0.01 to about 0.02 percent by weight of water. In yet another embodiment, the volume average particle size of the colored encapsulated toner can be controlled to about 3 microns in diameter by adjusting the outer coating cellulose material, such as TYLOSE ®, of from about 0.75 to about 1 percent by weight of water, and the ionic surfactant, such as sodium dodecyl sulfate, of from about 0.02 to about 0.04 percent by weight of water. Additionally, in another embodiment, the volume average particle size of the colored encapsulated toner can be controlled to about 0.5 micron in diameter by adjusting the outer coating cellulose material, such as TYLOSE ®, of from about 0.5 to about 1.25 percent by weight of water, and the ionic surfactant, such as sodium dodecyl sulfate, of from about 0.1 to about 0.5 percent by weight of water. Generally, higher concentration of outer coating material and ionic or inorganic surfactant tends to decrease the average particle size diameter of the colored encapsulated toner.

In an embodiment, the colored encapsulated toner composition can be prepared by (i) mixing a core resin forming monomer, such as styrene, from about 0.6 mole to 0.8 mole, stearyl methacrylate from about 0.06 mole to about 0.08 mole, a colorant, such as HELIOGEN BLUE TM, from about 0.01 mole to about 0.015 mole, an inner shell forming diisocyanate monomer, such as DESMODUR W TM, of from about 0.03 mole to about 0.05 mole and free-radical iniators, such as VAZO 67 TM, from about 0.001 mole to about 0.003 mole; (ii) dispersing this mixture using a high shearing device, such as a Brinkman 45G probe, at from about 8,000 to about 10,000 rpm for a duration of from about 30 to about 120 seconds, in a vessel containing from about a 0.5 liter to about 0.75 liter of water, dissolved therein an outer coating cellulose surfactant, such as TYLOSE ®, of from about 0.75 to about 1 percent by weight of water, and an ionic surfactant such as sodium dodecyl sulfate of from about 0 to 0.04 percent by weight of water; (iii) adding the second inner shell diamine monomer, such as DYTEK A TM, of from about 0.03 mole to about 0.05 mole; and (iv) heating the mixture to effect free-radical core polymer formation, from about 60° C. to about 95° C., and for a duration of from about 360 minutes to about 720 minutes. The toner product is then washed by centrifugation from about four to about six times, and dried using preferably a fluidized bed operated of from about 30° C. to about 60° C. for a duration of from about 240 minutes to about 480 minutes, known flow additives to improve flow characteristics may then optionally be employed such as AEROSIL R-200 ® and the like.

Illustrative examples of core monomers, which are subsequently polymerized, include a number of known components such as acrylates, methacrylates, olefins including styrene and its derivatives such as methyl styrene, and the like. Specific examples of core monomers include methyl acrylate, methyl methacrylate, ethyl acrylate, ethyl methacrylate, propyl acrylate, propyl methacrylate, butyl acrylate, butyl methacrylate, pentyl acrylate, pentyl methacrylate, hexyl acrylate, hexyl methacrylate, heptyl acrylate, heptyl methacrylate, octyl acrylate, octyl methacrylate, cyclohexyl acrylate, cyclohexyl methacrylate, lauryl acrylate, lauryl methacrylate, stearyl acrylate, stearyl methacrylate, benzyl acrylate, benzyl methacrylate, ethoxypropyl acrylate, ethoxypropyl methacrylate, methylbutyl acrylate, methylbutyl methacrylate, ethylhexyl acrylate, ethylhexyl methacrylate, methoxybutyl acrylate, methoxybutyl methacrylate, cyanobutyl acrylate, cyanobutyl methacrylate, tolyl acrylate, tolyl methacrylate, styrene, substituted styrenes, other substantially equivalent addition monomers, and known addition monomers, reference for example U.S. Pat. No. 4,298,672, the disclosure of which is totally incorporated herein by reference, and mixtures thereof. Illustrative examples of optional preformed core resins include styrene polymers, such as styrene-butadiene copolymers, PLIOLITES ®, PLIOTONES ®, polyesters, acrylate and methacrylate polymers, and the like.

Various known colorants may be selected for the toner compositions of the present invention providing, for example, that they do not substantially interfere with the free radical polymerization. Typical examples of specific colorants, preferably present in an effective amount of, for example, from about 3 to about 10 weight percent of toner include PALIOGEN VIOLET 5100 TM and 5890 TM (BASF), NORMANDY MAGENTA RD-2400 TM (Paul Uhlich), PERMANENT VIOLET VT2645 TM (Paul Uhlich), HELIOGEN GREEN L8730 ® (BASF), ARGYLE GREEN XP-111-S TM (Paul Uhlich), BRILLIANT GREEN TONER GR 0991 ® (Paul Uhlich), LITHOL SCARLET D3700 ® (BASF), TOLUIDINE RED TM (Aldrich), SCARLET FOR THERMOPLAST NSD RED TM (Aldrich), LITHOL RUBINE TONER TM (Paul Uhlich), LITHOL SCARLET 4440 TM, NBD 3700 TM (BASF), BON RED C TM (Dominion Color), ROYAL BRILLIANT RED RD-8192 TM (Paul Uhlich), ORACET PINK RF TM (Ciba Geigy), PALIOGEN RED 3340 TM and 3871K TM (BASF), LITHOL FAST SCARLET L4300 TM (BASF), HELIOGEN BLUE D6840 TM, D7080 TM, K7090 TM, K6902 TM, K6910 TM and L7020 TM (BASF), SUDAN BLUE OS TM (BASF), NEOPEN BLUE FF4012 TM (BASF), PV FAST BLUE B2G01 TM (American Hoechst), IRGALITE BLUE BCA TM (Ciba Geigy), PALIOGEN BLUE TM 6470 (BASF), SUDAN II TM, III TM and IV TM (Matheson, Coleman, Bell), SUDAN ORANGE TM (Aldrich), SUDAN ORANGE 220 TM (BASF), PALIOGEN ORANGE 3040 TM (BASF), ORTHO ORANGE OR 2673 TM (Paul Uhlich), PALIOGEN YELLOW 152 TM and 1560 TM (BASF), LITHOL FAST YELLOW 0991K TM (BASF), PALIOTOL YELLOW 1840 TM (BASF), NOVAPERM YELLOW FGL TM (Hoechst), PERMANENT YELLOW YE 0305 TM (Paul Uhlich), LUMOGEN YELLOW D0790 TM (BASF), SUCO-GELB L1250 TM (BASF), SUCO-YELLOW D1355 TM (BASF), SICO FAST YELLOW D1165 TM, D1355 TM and D1351 TM (BASF), HOSTAPERM PINK E TM (Hoechst), FANAL PINK D4830 TM (BASF), CINQUASIA MAGENTA TM (DuPont), PALIOGEN BLACK L0084 TM (BASF), PIGMENT BLACK K801 (BASF) and carbon blacks such as REGAL 330 ® (Cabot), CARBON BLACK 5250 ® and 5750 ® (Columbian Chemicals), and the like.

Examples of the outer shell coating polymers selected for the toners and processes of the present invention include alkyl celluloses with the alkyl groups containing, for example, from 1 to about 10 carbon atoms; and more specifically methyl cellulose, ethyl cellulose, hydroxyethyl cellulose, hydroxypropyl cellulose, hydroxyethylmethyl cellulose, TYLOSE ® and the like. The effective concentration of the cellulose polymer in the aqueous phase at the dispersion or microdroplet formation step is, for example, from about 0.1 percent by weight to about 5 percent by weight, with the preferred amount being determined primarily by the nature of the toner precursor materials and the desired toner particle size. In embodiments, inorganic surfactants are also utilized in combination with the cellulose polymer for achieving a smaller microdroplet size. Illustrative examples of suitable inorganic surfactants include alkali salts, such as potassium oleate, potassium caprate, potassium stearate, sodium laurate, sodium dodecyl sulfate, sodium oleate, sodium laurate, and the like. The effective concentration of inorganic surfactant that is generally employed is, for example, from about 0.005 to about 0.5 percent by weight, and preferably from about 0.01 to about 0.10 percent by weight. Known surface additives, such as silicas like AEROSIL R972®, metal oxides, such as tin oxide, in effective amounts such as about 0.5 to about 1 weight percent, and effective mixtures of the aforementioned additives can also be selected for the toners of the present invention.

Examples of preferred inner shell polymers include polyureas, polyamides, polyethers, polyurethanes, mixtures thereof, and the like, and which shells may contain within their structures certain soft, flexible moieties such as polyether functions which, for example, assist in the molecular packing of the shell materials as well as imparting the desirable low surface energy characteristics to the shell structure. The shell amounts are generally from about 5 to about 30 percent by weight of the toner, and have a thickness generally, for example, of less than about 5 microns as indicated herein. In one embodiment of the present invention, the encapsulant inner shells are formed by interfacial polycondensation of one or more diisocyanates with one or more diamines. Examples of diisocyanates include Uniroyal Chemical's diphenylmethane diisocyanate-based liquid polyether VIBRATHANES® such as B-635, B-843, and the like, toluene diisocyanate-based liquid polyether VIBRATHANES® such as B-604, B-614, and the like, and Mobay's Chemical Corporation's liquid polyether isocyanate prepolymers, E-21 TM or E-21A TM (product code number D-716), 743 (product code numbers D-301), 744 (product code number D-302), and the like. Other diisocyanates that can be selected for the formation of shell material are those available commercially including, for example, benzene diisocyanate, toluene diisocyanate, diphenylmethane diisocyanate, 1,6-hexamethylene diisocyanate, DESMODUR W TM, bis(4-isocyanatocyclohexyl)methane, MODUR CB-60 TM, MONDUR CB-75 TM, MONDUR MR TM, MONDUR MRS 10 TM, PAPI 27 TM, PAPI 135 TM, ISONATE 143L TM, ISONATE 181 TM, ISONATE 125M TM, ISONATE 191 TM, and ISONATE 240 TM. Illustrative examples of diamines suitable for the interfacial polycondensation shell formation include, for example, ethylenediamine, tetramethylenediamine, pentamethylenediamine, hexamethylenediamine, p-phenylenediamine, m-phenylenediamine, 2-hydroxy trimethylenediamine, diethylenetriamine, triethylenetetraamine, tetraethylenepentaamine, 1,8-diaminooctane, xylylene diamine, bis(hexamethylene)-triamine, tris(2-aminoethyl)amine, 4,4'-methylene bis(-cyclohexylamine), bis(3-aminopropyl)ethylene diamine, 1,3-bis(aminomethyl)cyclohexane, 1,5-diamino-2-methylpentane, piperazine, 2-methylpiperazine, 2,5-dimethylpiperazine, 1,4-bis(3-aminopropyl)-piperazine, and 2,5-dimethylpentamethylene diamine. Generally, the shell polymer comprises from about 5 to about 30 percent by weight of the total toner composition, and preferably comprises from about 10 percent by weight to about 20 percent by weight of the toner composition.

During the aforementioned interfacial polycondensation to form the inner shell, the temperature is maintained at from about 15° C. to about 55° C., and preferably from about 20° C. to about 30° C. Also, generally the reaction time is from about 5 minutes to about 5 hours, and preferably from about 20 minutes to about 90 minutes. Other temperatures and times can be selected, and further polyisocyanates and polyamines not specifically illustrated may be selected.

Illustrative examples of known free radical initiators that can be selected for the preparation of the toners include azo-type initiators such as 2,2'-azobis(dimethylvaleronitrile), azobis(isobutyronitrile), azobis(cyclohexanenitrile), azobis(methylbutyronitrile), mixtures thereof, and the like, peroxide initiators such as benzoyl peroxide, lauroyl peroxide, methyl ethyl ketone peroxide, isopropyl peroxycarbonate, 2,5-dimethyl-2,5-bis(2-ethylhexanoylperoxy)hexane, di-tert-butyl peroxide, cumene hydroperoxide, dichlorobenzoyl peroxide, and mixtures thereof, with the effective quantity of initiator being, for example, from about 0.1 percent to about 10 percent by weight of that of core monomer.

For two component developers, carrier particles including steel ferrites, copper zinc ferrites, and the like, with or without coatings, can be admixed, from about 1 to about 3 parts of toner for each 100 parts of carrier for example, with the encapsulated toners of the present invention, reference for example the carriers illustrated in U.S. Pat. Nos. 4,937,166; 4,935,326; 4,560,635; 4,298,672; 3,839,029; 3,847,604; 3,849,182; 3,914,181; 3,929,657 and 4,042,518, the disclosures of which are totally incorporated herein by reference.

The following examples are being submitted to further define various species of the present invention. These examples are intended to be illustrative only and are not intended to limit the scope of the present invention. Comparative Examples are also provided.

COMPARATIVE EXAMPLE I

A 6.8 micron (volume average particle diameter) cellulose-coated cyan toner, as disclosed in Example I of copending patent application U.S. Ser. No. 720,300 (D/90516), which comprises a core coated with an alkyl cellulose shell material, was prepared as follows:

A mixture of 185.0 grams of isobutyl methacrylate, and 4.0 grams of HELIOGEN BLUE K7090 (BASF) pigment was ball milled for 24 hours. To this mixture were added 3.0 grams each of two free radical initiators, 2,2'-azobis-(2,4-dimethylvaleronitrile) and 2,2'-azobis-(isobutyronitrile), and the mixture was roll blended until all the free radical initiators were dissolved. One hundred and fifty (150) grams of the resulting mixture were then transferred to a 2-liter reaction vessel containing 700 milliliters of a 1.0 percent aqueous TYLOSE® solution, and the resulting mixture was homogenized for 2 minutes using a Brinkmann polytron operating at 10,000 rpm. Thereafter, the mixture was mechanically stirred at room temperature, 25° C., for 30 minutes before heating to 80° C. over a period of 1 hour, and maintained at this temperature for another 10 hours. After cooling down to room temperature, the reaction product was washed repeatedly with water until the aqueous phase was clear, and the product was then freeze dried for 24 hours. The resulting toner particle product evidenced a volume average particle diameter of 6.8 microns, and a particle size distribution of 1.31 according to Coulter Counter measurements.

Fifty (50.0) grams of the above prepared dried toner particles were dry blended with a mixture of 0.75 gram of AEROSIL R812 ® and 0.80 gram of conductive tin oxide powder for 10 minutes using a Grey blender with its blending impeller operating at 2,500 rpm. A negatively charged developer was prepared by blending 2 parts by weight of the above toner particles with 98 parts by weight of carrier particles comprised of a ferrite core coated with a terpolymer of methyl methacrylate, styrene, and vinyl triethoxysilane polymer, 0.7 weight percent of coating, reference U.S. Pat. Nos. 3,467,634 and 3,526,533, the disclosures of which are totally incorporated herein by reference. Latent images were then formed in a xerographic experimental imaging device similar to the Xerox Corporation 9200, and subsequent to the development of images with the aforementioned prepared toner, the images was transferred to a paper substrate and fixed with heat, about 160° C., with a VITON ® fuser roll. The toner image thereafter was measured using a GARDNER TM gloss unit and displayed a gloss value of 55 gloss units.

COMPARATIVE EXAMPLE II

A colored encapsulated yellow toner, as disclosed in Example I of U.S. Pat. No. 4,766,051, the disclosure of which is totally incorporated herein by reference, which comprises a core of polybutadiene resin and yellow pigment, and a polyurea shell material, was prepared as follows:

NOVAPERM YELLOW FGL TM (Hoechst), 5 grams; VISTANEX LMMH TM, 12 grams; cyclohexane ACS (Caledon) 50 grams; and 5 millimeters diameter ball bearings (⅓ of the total volume) were placed in a 250 milliliter plastic bottle and ball milled for 16 hours. Thereafter, TDI-80, a mixture of 2,4 and 2,6 toluene diisocyanate, 9 grams, and DESMODUR RF TM (tris(p-isocyanato-phenyl)thiophosphate), 5 grams, in dichloromethane, 20 milliliters, were added to the pigment mixture. The mixture was then homogenized with a Brinkman homogenizer PT 10-35 set at speed 9for 90 seconds (generator PT-20). Thereafter, the mixture was then dispersed in a 1 percent poly(vinyl alcohol) solution, 500 milliliters and 2-decanol, 0.5 milliliter with a Brinkman homogenizer PT 10-35 set at speed 7 to 15 seconds (generator PT-35/4). Subsequently, this mixture was transferred to a 2 liter beaker equipped with a mechanical stirrer, and an oil bath under the beaker. Diethylene triamine, 5 milliliters in water, 22 milliliters, was added to the aforementioned mixture over a period of 2 minutes, and the mixture was kept at room temperature overnight. During this period, an interfacial polymerization reaction ensued enabling the polyurea polymer shell to formulate. The next day, about 18 hours later, the temperature was increased to 65° C. for 8 hours to permit the reaction to proceed to completion and to remove volatiles, such as the residual solvents, cyclohexane and dichloromethane. The reaction mixture was then allowed to stabilize at room temperature, and the yellow toner resulting was comprised of polyisobutylene core polymer, about 37 percent by weight, the yellow pigment, 16 percent by weight, and a polyurea shell, 47 percent by weight.

Fifty (50.0) grams of the above prepared dried toner particles were dry blended with a mixture of 0.75 gram of AEROSIL R812 ® and 0.80 grams of conductive tin oxide powder for 10 minutes using a Grey blender with its blending impeller operating at 2,500 rpm. A negatively charged developer was prepared by blending 2 parts by weight of the above toner particles with 98 parts by weight of carrier particles comprised of a ferrite core coated with a terpolymer of methyl methacrylate, styrene, and vinyl triethoxysilane polymer, 0.7 weight percent of coating, reference U.S. Pat. Nos. 3,467,634 and 3,526,533, the disclosures of which are totally incorporated herein by reference. The toner latent images were then formed in a xerographic experimental imaging device similar to the Xerox Corporation 9200, and subsequent to the development of images with the aforementioned prepared toner, the images were then transferred to a paper substrate and fixed with heat, about 160° C., with a VITON ® fuser roll. The toner image thereafter was measured using a GARDNER TM gloss unit and displayed a gloss value of 35 gloss units.

EXAMPLE I

A 7.1 micron (volume average particle diameter) encapsulated cyan toner was prepared as follows.

A mixture of 103.9 grams of styrene, 69.3 grams of stearyl methacrylate, 11.9 grams of HELIOGEN BLUE K7090 TM (BASF) pigment flushed in 42 percent by weight of poly(styrene-butylmethacrylate), 3.0 grams each of two free radical initiators, 2,2'-azobis-(2,4-dimethylvaleronitrile) and 2,2'-azobis-(isobutyronitrile), and 34.5 grams of bis (p-isocyanatocyclohexyl)-methane (DESMODUR W TM) was formed. The mixture was shaken in a polyethylene closed polyethylene container (250 milliliters) until all the free radical initiators were dissolved. One hundred and fifty (150) grams of the resulting mixture was then transferred to a 2-liter reaction vessel containing 700 milliliters of a 1.0 percent aqueous methyl cellulose (TYLOSE ®) solution and 0.005 percent of sodium dodecyl sulfate, and the resulting mixture was homogenized for 2 minutes using a Brinkmann polytron operating at 10,000 rpm. Thereafter, 15.9 grams of 2,5-pentamethylene diamine (DYTEK A TM) was added and the mixture was mechanically stirred at room temperature, 25° C., for 30 minutes before heating to 80° C. over a period of 1 hour, and maintained at this temperature for another 10 hours. After cooling down to room temperature, about 25° C., the reaction product was washed repeatedly with water until the aqueous phase was clear, and the product was then freeze dried for 48 hours. The resulting toner was comprised of 76 percent by toner weight of styrene-methacrylate core resin, 3 percent by toner weight of pigment, 21 percent by toner weight of inner shell polyurea, and less than one percent by toner weight of outer shell alkyl cellulose coating. The dry product evidenced a volume average particle diameter of 7.1 microns, and a particle size distribution of 1.33 according to Coulter Counter measurements.

Fifty (50.0) grams of the above prepared dried toner particles were then dry blended with a mixture of 0.25 gram of AEROSIL R812 ® and 0.40 gram of conductive tin oxide powder for 15 minutes using a Grey blender with its blending impeller operating at 2,500 rpm. A negatively charged developer was prepared by blending 2 parts by weight of the above toner particles with 98 parts by weight of carrier particles comprised of a ferrite core coated with a terpolymer of methyl methacrylate, styrene, and vinyl triethoxysilane polymer, 0.7 weight percent of coating, reference U.S. Pat. Nos. 3,467,634 and 3,526,533, the disclosures of which are totally incorporated herein by reference. The toner displayed a triboelectric value of −22 microcoulombs per gram as determined in the known Faraday Cage apparatus. The toner latent images were then formed in a xerographic experimental imaging device similar to the Xerox Corporation 9200, and subsequent to the development of images with the aforementioned prepared toner, the images were then transferred to a paper substrate and fixed with heat, about 120° C., with a VITON ® fuser roll. The toner images thereafter were measured using a GARDNER TM gloss unit and displayed a gloss value of a 14 gloss units. The gloss values were about 41 gloss units lower than comparative Example I, and about 21 gloss units lower than that of Eaxmple II.

EXAMPLE II

A 5 micron (volume average particle diameter) encapsulated cyan toner was prepared as follows.

A mixture of 103.9 grams of styrene, 69.3 grams of stearyl methacrylate, 11.9 grams of HELIOGEN BLUE K7090 TM (BASF) pigment flushed in 42 percent by weight of poly(styrene-butylmethacrylate), 3.0 grams each of two free radical initiators, 2,2'-azobis-(2,4-dimethylvaleronitrile) and 2,2'-azobis-(isobutyronitrile), and 34.5 grams of bis(p-isocyanatocyclohexyl)-methane (DESMODUR W TM). The mixture was shaken in a closed polyethylene container (250 milliliters) until all the free radical initiators were dissolved. One hundred and fifty (150) grams of the resulting mixture were then transferred to a 2-liter reaction vessel containing 700 milliliters of a 1.0 percent aqueous methyl cellulose (TYLOSE ®) solution and 0.01 percent of sodium dodecylsulfate, and the resulting mixture was homogenized for 2 minutes using a Brinkmann polytron operating at 10,000 rpm. Thereafter, 15.9 grams of 2,5-pentamethylene diamine (DYTEK A TM) was added and the mixture was mechanically stirred at room temperature, 25° C., for 30 minutes before heating to 80° C. over a period of 1 hour, and maintained at this temperature for another 10 hours. After cooling down to room temperature, about 25° C., the reaction product was washed repeatedly with water until the aqueous phase was clear, and the product was then freeze dried for 48 hours. The resulting toner was comprised of 76 percent by toner weight of styrene-methacrylate core resin, 3 percent by toner weight of pigment, 21 percent by toner weight of inner shell polyurea, and about one percent by toner weight of outer shell alkyl cellulose coating. The dry toner product evidenced a volume average particle diameter of 5 microns, and a particle size distribution of 1.33 according to Coulter Counter measurements.

A negatively charged developer was prepared similarly to that decribed in Example I. The toner displayed a triboelectric value of −17 microcoulombs per gram as determined in the known Faraday Cage apparatus. The toner latent images were then formed in a xerographic experimental imaging device similar to the Xerox Corporation 9200, and subsequent to the development of images with the aforementioned prepared toner, the images were then transferred to a paper substrate and fixed with heat, about 160° C., with a VITON ® fuser roll. The toner image thereafter were measured using a GARDNER TM gloss unit and displayed a gloss value of 14 gloss units.

EXAMPLE III

A 3 micron (volume average particle diameter) encapsulated cyan toner was prepared as follows.

There was formed a mixture of 103.9 grams of styrene, 69.3 grams of stearyl methacrylate, 11.9 grams of HELIOGEN BLUE K7090 TM (BASF) pigment flushed in 42 percent by weight of poly(styrenebutylmethacrylate), 3.0 grams each of two free radical intiators, 2,2'-azobis-(2,4-dimethylvaleronitrile) and 2,2'-azobis-(isobutyronitrile), and 34.5 grams of bis(p-isocyanatocyclohexyl)-methane (DESMODUR W TM). The mixture was shaken in a closed polyethylene container (250 milliliters) until all the free radical initiators were dissolved. One hundred and fifty (150) grams of the resulting mixture were then transferred to a 2-liter reaction vessel containing 700 milliliters of a 1.0 percent aqueous methyl cellulose (TYLOSE ®) solution and 0.03 percent of sodium dodecylsulfate, and the resulting mixture was homogenized for 2 minutes using a Brinkmann polytron operating at 10,000 rpm. Thereafter, 15.9 grams of 2,5-pentamethylene diamine (DYTEK A TM) were added and the mixture was mechanically stirred at room temperature, 25° C., for 30 minutes before heating to 80° C. over a period of 1 hour, and maintained at this temperature for another 10 hours. After cooling down to room temperature, about 25° C., the reaction product was washed repeatedly with water until the aqueous phase was clear, and the product was then freeze dried for 48 hours. The resulting toner was comprised of 76 percent by toner weight of a styrene-methacrylate core resin, 3 percent by toner weight of pigment, 21 percent by toner weight of inner shell polyurea, and about 1 percent by toner weight of outer shell alkyl cellulose coating. The dry product evidenced a volume average particle diameter of 5 microns, and a particle size distribution of 1.33 according to Coulter Counter measurements.

A negatively charged developer was prepared similarly to that described in Example I. The toner displayed a triboelectric value of −11 microcoulombs per gram as determined in the known Faraday Cage apparatus. Latent images were then formed in a xerographic experimental imaging device similar to the Xerox Corporation 9200, and subsequent to the development of images with the aforementioned prepared toner, the images were then transferred to a paper substrate and fixed with heat, about 160° C., with a VITON ® fuser roll. The images were measured using a GARDNER TM gloss unit and displayed a gloss value of 10 gloss units.

EXAMPLE IV

A 0.5 micron (volume average particle diameter) encapsulated cyan toner was prepared as follows.

There was prepared a mixture of 103.9 grams of styrene, 69.3 grams of stearyl methacrylate, 11.9 grams of HELIOGEN BLUE K7090 TM (BASF) pigment flushed in 42 percent by weight of poly(styrene-butylmethacrylate), 3.0 grams each of two free radical initiators, 2,2'-azobis-(2,4-dimethylvaleronitrile) and 2,2'-azobis-(isobutyronitrile), and 34.5 grams of bis(p-isocyanatocyclohexyl)-methane (DESMODUR W TM). The mixture was shaken in a closed polyethylene container (250 milliliters) until all the free radical initiators were dissolved. One hundred and fifty (150) grams of the resulting mixture were then transferred to a 2-liter reaction vessel containing 700 milliliters of a 1.0 percent aqueous methyl cellulose (TYLOSE ®) solution and 0.5 percent of sodium dodecylsulfate, and the resulting mixture was homogenized for 2 minutes using a Brinkmann polytron operating at 10,000 rpm. Thereafter, 15.9 grams of 2,5-pentamethylene diamine (DYTEK A TM) was added and the mixture was mechanically stirred at room temperature, 25° C., for 30 minutes before heating to 80° C. over a period of 1 hour, and maintained at this temperature for another 10 hours. After cooling down to room temperature, about 25° C., the reaction product was washed repeatedly with water until the aqueous phase was clear, and the product was then freeze dried for 48 hours. The resulting toner was comprised of 76 percent by toner weight of styrene-methacrylate core resin, 3 percent by toner weight of pigment, 21 percent by toner weight of inner shell polyurea, and about 1 percent by toner weight of outer shell alkyl cellulose coating. The dry product evidenced a volume average particle diameter of 0.5 micron, and a particle size distribution of 1.43 according to Coulter Counter measurements.

EXAMPLE V

A 5.3 micron (volume average particle diameter) encapsulated cyan toner was prepared as follows.

There was prepared a mixture of 103.9 grams of styrene, 69.3 grams of lauryl methacrylate, 11.9 grams of HELIOGEN BLUE K7090 TM (BASF) pigment flushed in 42 percent by weight of poly(styrene-butylmethacrylate), 3.0 grams each of two free radical initiators, 2,2'azobis-(2,4-dimethylvaleronitrile) and 2,2'-azobis-(isobutyronitrile), and 34.5 grams of bis(p-isocyanatocyclohexyl)-methane (DESMODUR W TM). The mixture was shaken in a polyethylene closed polyethylene container (250 milliliters) until all the free radical initiators were dissolved. One hundred and fifty (150) grams of the resulting mixture were then transferred to a 2-liter reaction vessel containing 700 milliliters of a 1.0 percent aqueous methyl cellulose (TYLOSE ®) solution and 0.01 percent of sodium dodecylsulfate, and the resulting mixture was homogenized for 2 minutes using a Brinkmann polytron operating at 10,000 rpm. Thereafter, 15.9 grams of 2,5-pentamethylene diamine (DYTEK A TM) was added and the mixture was mechanically stirred at room temperature, 25° C., for 30 minutes before heating to 80° C. over a period of 1 hour, and maintained at this temperature for another 10 hours. After cooling down to room temperature, about 25° C., the reaction product was washed repeatedly with water until the aqueous phase was clear, and the product was then freeze dried for 48 hours. The resulting toner was comprised of 76 percent by toner weight of styrene-methacrylate core resin, 3 percent by toner weight of pigment, 21 percent by toner weight of inner shell polyurea, and about 1 percent by toner weight of outer shell alkyl cellulose coating. The dry product evidenced a volume average particle diameter of 5.3 microns, and a particle size distribution of 1.38 according to Coulter Counter measurements.

A negatively charged developer was prepared similarly to that described in Example I. The toner displayed a triboelectric value of −25 microcoulombs per gram as determined in the known Faraday Cage apparatus. Latent images were then formed in a xerographic experimental imaging device similar to the Xerox Corporation 9200, and subsequent to the development of images with the aforementioned prepared toner, the images were then transferred to a paper substrate and fixed with heat, about 160° C., with a VITON ® fuser roll. The toner images thereafter were measured using a GARDNER TM gloss unit and displayed a gloss value of 7 gloss units.

EXAMPLE VI

A 6.0 micron (volume average particle diameter) encapsulated cyan toner was prepared as follows.

There was prepared a mixture of 103.9 grams of styrene, 34.7 grams of lauryl methacrylate, 34.7 grams of stearyl methacrylate, 11.9 grams of HELIOGEN BLUE K7090 TM (BASF) pigment flushed in 42 percent by weight of poly(styrene-butylmethacrylate), 3.0 grams each of two free radical initiators, 2,2'-azobis-(2,4-dimethylvaleronitrile) and 2,2'-azobis-(isobutyronitrile), and 34.5 grams of bis(p-isocyanatocyclohexyl)-methane (DESMODUR W TM). The mixture was shaken in a polyethylene closed polyethylene container (250 milliliters) until all the free radical initiators were dissolved. One hundred and fifty (150) grams of the resulting mixture were then transferred to a 2-liter reaction vessel containing 700 milliliters of a 1.0 percent aqueous methyl cellulose (TYLOSE TM) solution and 0.01 percent of sodium dodecyl sulfate, and the resulting mixture was homogenized for 2 minutes using a Brinkmann polytron operating at 10,000 rpm. Thereafter, 15.9 grams of 2,5-pentamethylene diamine (DYTEK A TM) was added and the mixture was mechanically stirred at room temperature, 25° C., for 30 minutes before heating to 80° C. over a period of 1 hour, and maintained at this temperature for another 10 hours. After cooling down to room temperature, about 25° C., the reaction product was washed repeatedly with water until the aqueous phase was clear, and the product was then freeze dried for 48 hours. The resulting toner was comprised of 76 percent by toner weight of styrene-methacrylate core resin, 3 percent by toner weight of pigment, 21 percent by toner weight of inner shell polyurea, and about 1 percent by toner weight of outer shell alkyl cellulose coating. The dry product evidenced a volume average particle diameter of 6.0 microns, and a particle size distribution of 1.39 according to Coulter Counter measurements.

A negatively charged developer was prepared similarly to that described in Example I. The toner displayed a triboelectric value of −23 microcoulombs per gram as determined in the known Faraday Cage apparatus. Latent images were then formed in a xerographic experimental imaging device similar to the Xerox Corporation 9200, and subsequent to the development of images with the aforementioned prepared toner, the images were then transferred to a paper substrate and fixed with heat, about 160° C., with a VITON ® fuser roll. The toner images thereafter were measured using a GARDNER TM gloss unit and displayed a gloss value of 3 gloss units.

EXAMPLE VII

A 2.0 micron (volume average particle diameter) encapsulated cyan toner was prepared as follows.

There was formed a mixture of 103.9 grams of styrene, 34.7 grams of lauryl methacrylate, 34.7 grams of stearyl methacrylate, 11.9 grams of HELIOGEN BLUE K7090 TM (BASF) pigment flushed in 42 percent by weight of poly(styrene-butylmethacrylate), 3.0 grams each of two free radical initiators, 2,2'-azobis-(2,4-dimethylvaleronitrile) and 2,2'-azobis-(isobutyronitrile), and 34.5 grams of bis(p-isocyanatocyclohexyl)-methane (DESMODUR W TM). The mixture was shaken in a polyethylene closed polyethylene container (250 milliliters) until all the free radical initiators were dissolved. One hundred and fifty (150) grams of the resulting mixture were then transferred to a 2-liter reaction vessel containing 700 milliliters of a 1.0 percent aqueous methyl cellulose (TYLOSE®) solution and 0.04 percent of sodium dodecyl sulfate, and the resulting mixture was homogenized for 2 minutes using a Brinkmann polytron operating at 10,000 rpm. Thereafter, 15.9 grams of 2,5-pentamethylene diamine (DYTEK A TM) was added and the mixture was mechanically stirred at room temperature, 25° C., for 30 minutes before heating to 80° C. over a period of 1 hour, and maintained at this temperature for another 10 hours. After cooling down to room temperature, about 25° C., the reaction product was washed repeatedly with water until the aqueous phase was clear, and the product was then freeze dried for 48 hours. The resulting toner was comprised of 76 percent by toner weight of styrene-methacrylate core resin, 3 percent by toner weight of pigment, 21 percent by toner weight of inner shell polyurea, and about 1 percent by toner weight of outer shell alkyl cellulose coating. The dry product evidenced a volume average particle diameter of 2.0 microns, and a particle size distribution of 1.44 according to Coulter Counter measurements.

Other embodiments and modifications of the present invention may occur to those skilled in the art subsequent to a review of the present application; these embodiments and modifications, as well as equivalents thereof, are also included within the scope of this invention.

What is claimed is:

1. A dry encapsulated toner composition consisting essentially of a core comprised of a polymer resin or resins, pigment, dye, or mixtures thereof, an inner shell comprised of a polyurea, a polyurethane, a polyamide, a polyester, or polyether resin, and thereover an outer shell coating comprised of an alkyl cellulose, and which toner has a low gloss of about 1 to about 15 gloss units.

2. A toner in accordance with claim 1 wherein the polymer core resin is an acrylate polymer, a methacrylate polymer, a styrene-acrylate polymer or a styrene-methacrylate copolymer.

3. A toner composition in accordance with claim 1 with a volume average particle diameter of 7.1 microns, a particle size distribution of 1.33, and a gloss value of 14.

4. A toner in accordance with claim 1 wherein the alkyl cellulose is a methyl cellulose, a hydroxyethylmethyl cellulose, or a hydroxypropyl cellulose.

5. A toner in accordance with claim 1 wherein the pigment is carbon black, magnetite, or mixtures thereof.

6. A toner in accordance with claim 1 wherein the pigment, dye, or mixture thereof, is cyan, yellow, magenta, red, green, blue, or brown.

7. A toner in accordance with claim 1 containing surface additives.

8. A toner composition consisting essentially of a core comprised of a polymer resin, pigment particles, thereover an inner shell resin, and thereover an outer shell cellulose coating, and a surface additive, or a mixture of surface additives, and wherein said toner has a gloss of from 1 to 15 gloss units.

9. A toner in accordance with claim 8 wherein the surface additives are comprised of metal salts, metal salts of fatty acids, colloidal silicas, conductive metal oxide powders, quaternary ammonium salts, metal complexes, surfactants, or mixtures thereof.

10. A toner in accordance with claim 1 wherein the inner shell is of a thickness of from about 0.1 to about 2 microns.

11. A toner in accordance with claim 1 wherein the outer shell coating is of a thickness of from about 0.0001 to about 0.5 micron.

12. A toner in accordance with claim 1 wherein the inner shell forms a continuous layer on the core material.

13. A toner in accordance with claim 1 wherein the outer shell coating forms a continuous layer on the inner shell material.

14. A toner in accordance with claim 1 wherein the core resin is from about 60 percent to about 85 percent by weight of toner, the pigment is from about 3 percent to about 10 percent by weight of toner, the inner shell is from about 10 percent to about 30 percent by weight of the toner, and the outer shell coating is from about 0.5 percent to about 10 percent by weight of the toner.

15. A toner in accordance with claim 1 wherein the polymer resin is derived from polymerization of addition monomers selected from the group consisting of methyl acrylate, methyl methacrylate, ethyl acrylate, ethyl methacrylate, propyl acrylate, propyl methacrylate, butyl acrylate, butyl methacrylate, pentyl acrylate, pentyl methacrylate, hexyl acrylate, hexyl methacrylate, heptyl acrylate, heptyl methacrylate, octyl acrylate, octyl methacrylate, cyclohexyl acrylate, cyclohexyl methacrylate, lauryl acrylate, lauryl methacrylate, stearyl acrylate, stearyl methacrylate, benzyl acrylate, benzyl methacrylate, ethoxypropyl acrylate, ethoxypropyl methacrylate, methylbutyl acrylate, methylbutyl methacrylate, ethylhexyl acrylate, ethylhexyl methacrylate, methoxybutyl acrylate, methoxybutyl methacrylate, cyanobutyl acrylate, cyanobutyl methacrylate, tolyl acrylate, tolyl methacrylate, styrene, and substituted styrenes.

16. A toner in accordance with claim 1 wherein the inner shell polyurea resin is derived from the interfacial polymerization of a diamine and diisocyanate.

17. A toner in accordance with claim 16 wherein the diamine monomer is selected from the group consisting of ethylene diamine, propylene diamine, butylene diamine, pentylene diamine, hexane diamine, p-phenylenediamine, m-phenylenediamine, 2-hydroxy trimethylenediamine, diethylenetriamine, triethylenetetraamine, tetraethylenepentaamine, 1,8-diaminooctane, xylylene diamine, bis(hexamethylene)-triamine, tris(2-aminoethyl)amine, 4,4'-methylene bis(-cyclohexylamine), bis(3-aminopropyl)ethylene diamine, 1,3-bis(aminomethyl)cyclohexane, 1,5-diamino-2-methylpentane, piperazine, 2-methylpiperazine, 2,5-dimethylpiperazine, 1,4-bis(3-aminopropyl)piperazine, and 2,5-dimethylpentamethylene diamine (DYTEK A TM).

18. A toner in accordance with claim 16 wherein the diisocyanate is selected from the group consisting of benzene diisocyanate, toluene diisocyanate, diphenylmethane diisocyanate, 1,6-hexamethylene diisocyanate, bis-(p-isocyanatocyclohexyl)-methane, xylene diisocyanate, 1,4-cyclohexyl diamine, polyether diisocyanate, and mixtures thereof.

19. A toner in accordance with claim 1 wherein the outer shell coating is selected from the group consisting of methyl cellulose, ethyl cellulose, hydroxyethyl cellulose, hydroxypropyl cellulose, hydroxyethylmethyl cellulose, and mixture thereof.

20. A toner in accordance with claim 1 wherein the polymer core resin is a styrene-stearyl methacrylate copolymer, the pigment is blue in color, the inner shell material is a polyurea obtained from bis-(p-isocyanatocyclohexyl)-methane and 2,5-pentamethyl diamine, and the outer shell coating is methyl cellulose.

21. A process for the preparation of toner compositions which comprises dispersing a mixture of addition monomers, an optional preformed polymer resin, a free radical initiator, a colorant comprised of a pigment, dye or mixtures thereof, and an inner shell forming monomer to form a stable microdroplet suspension in an aqueous medium containing an outer coating cellulose polymer, and an optional ionic or inorganic surfactant; subsequently adding an aqueous soluble monomer thereby forming the inner shell wall by interfacial polymerization; and thereafter initiating the core resin-forming free radical polymerization by heating, and separation of the toner by washing, centrifugation and drying, and wherein there results an encapsulated toner with an inner shell which functions to minimize or eliminate the seepage of the said inner core materials, thereby preventing toner aggregation or coalescing and an outer cellulose shell to provide a gloss or matte finish when such toner is utilized for the development of images, which gloss is for about 1 to about 15 gloss units.

22. A process in accordance with claim 21 wherein the dispersion is accomplished at a temperature of from about 25° C. to about 35° C.

23. A process in accordance with claim 21 wherein the polymerization is accomplished at a temperature of from about 35° C. to about 120° C.

24. A process in accordance with claim 21 wherein the inner shell polymerization is accomplished at a temperature of from about 20° C. to about 35° C.

25. A process in accordance with claim 21 wherein for the inner shell polymerization there is selected a polyurea, a polyester, a polyether or a polyurethane.

26. A process in accordance with claim 21 wherein for the outer shell cellulose polymer there is selected hydroxyethylmethyl cellulose, hydroxypropylmethyl cellulose, hydroxymethyl cellulose, and mixtures thereof.

27. A process in accordance with claim 21 wherein the inorganic surfactant is selected from the group consisting of potassium oleate, potassium caprate, potassium stearate, sodium laurate, sodium dodecyl sulfate, sodium oleate, sodium laurate, sodium dodecylbenzylsulfonate, dialkylbenzyl ammonium chloride, or mixtures thereof.

28. A process in accordance with claim 21 wherein the outer shell cellulose polymer and the inorganic surfactant selected are hydroxyethylmethyl cellulose and sodium dodecyl sulfate, respectively.

29. A process in accordance with claim 21 wherein the particle size of the colored encapsulated toner is from about 0.5 micron to about 15 microns.

30. A process in accordance with claim 21 wherein the particle size of the encapsulated toner is from about 2 microns to about 7 microns.

31. A process in accordance with claim 21 wherein the average particle diameter size of the toner is controlled by adjusting the concentration of the cellulose surfactant to from about 0.75 percent to about 1.25 percent, and the concentration of the ionic surfactant to from about 0 percent to about 0.5 percent by weight of water.

32. A process in accordance with claim 21 wherein the volume average particle size of the toner is controlled to about 7 microns by adjusting the concentration of the cellulose outer coating from about 0.75 percent to about 1.25 percent by weight of water, and adjusting the concentration of sodium dodecyl sulfate ionic surfactant from about 0 to about 0.005 percent by weight of the aqueous phase.

33. A process in accordance with claim 21 wherein the volume average particle size of the toner is controlled to about 5 microns by adjusting the concentration of the cellulose outer coating from about 0.75 percent to about 1.25 percent by weight of water, and adjusting the concentration of sodium dodecyl sulfate ionic surfactant from about 0.01 to about 0.02 percent by weight of the aqueous phase.

34. A process in accordance with claim 21 wherein the volume average particle size of the toner is controlled to about 3 microns by adjusting the concentration of the cellulose outer coating from about 0.75 percent to about 1.25 percent by weight of water, and adjusting the concentration of sodium dodecyl sulfate ionic surfactant from about 0.02 to about 0.04 percent by weight of the aqueous phase.

35. A process in accordance with claim 21 wherein the volume average particle size of the toner is controlled to about 0.5 micron by adjusting the concentration of methyl cellulose outer coating from about 0.75 percent to about 1.25 percent by weight of water, and adjusting the concentration of sodium dodecyl sulfate ionic surfactant from about 0.1 to about 0.5 percent by weight of the aqueous phase.

36. An imaging process which comprises the generation of an image on an imaging surface, subsequently developing this image with the toner composition of claim 1, thereafter transferring the image to a suitable substrate, and permanently affixing the image thereto.

37. An imaging method in accordance with claim 36 wherein fixing is accomplished by heat.

38. An imaging method in accordance with claim 36 wherein fixing is accomplished by a combination of pressure and heat.

39. An imaging method in accordance with claim 36 wherein fixing is accomplished by the use of a silicone rubber, TEFLON ®, or a VITON ® surface fuser roll.

40. An imaging method in accordance with claim 39 wherein the gloss level of the fixed toner image is from about 1 gloss units to about 14 gloss units.

41. An imaging method in accordance with claim 39 wherein the gloss level of the fixed toner is from about 3 gloss units to about 14 gloss units.

42. A toner in accordance with claim 1 wherein the gloss level for the fixed toner is from about 3 gloss units to about 14 gloss units.

43. A toner in accordance with claim 2 wherein the gloss level for the fixed toner is from about 3 gloss units to about 14 gloss units.

44. A toner in accordance with claim 1 wherein the toner particles have an average particle diameter of from about 0.5 micron to about 7 microns, and wherein the toner has a narrow particle size distribution of less than 1.35 as measured by a Coulter Counter.

* * * * *